US007229107B2

(12) United States Patent
Kuckertz

(10) Patent No.: US 7,229,107 B2
(45) Date of Patent: Jun. 12, 2007

(54) SECURITY SEAL FOR CARGO CONTAINERS

(76) Inventor: Jens Kuckertz, Parkallee 109, 28209, Bremen (DE)

( * ) Notice: Subject to any disclaimer, the term of this patent is extended or adjusted under 35 U.S.C. 154(b) by 203 days.

(21) Appl. No.: 10/950,741

(22) Filed: Sep. 27, 2004

(65) Prior Publication Data

US 2006/0081019 A1 Apr. 20, 2006

Related U.S. Application Data

(60) Provisional application No. 60/506,106, filed on Sep. 25, 2003.

(51) Int. Cl.
*B65D 27/30* (2006.01)

(52) U.S. Cl. ..... 292/307 R; 70/57.1; 70/439

(58) Field of Classification Search ..... 292/307 R; 70/57.1, 439

See application file for complete search history.

(56) References Cited

U.S. PATENT DOCUMENTS 3,441,304 A * 4/1969 Chidley et al. ..... 292/307 R
3,963,145 A * 6/1976 Fegley et al. ..... 222/5
4,326,741 A * 4/1982 Wilson ..... 292/307 R
4,793,644 A 12/1988 Swift ..... 292/320
5,058,088 A 10/1991 Haas et al. ..... 368/327
5,125,700 A 6/1992 Fattori et al. ..... 292/318
5,755,175 A * 5/1998 White et al. ..... 116/206

* cited by examiner

*Primary Examiner*—Gary Estremsky
(74) *Attorney, Agent, or Firm*—Harold L. Marquis; Scott A. Horstemeyer; James W. Kayden

(57) ABSTRACT

The security seal for cargo containers and freight trailers which has a gas cartridge which supplies gas through a two position valve when it is opened and onto a two way valve which in the activated position supplies gas under pressure to a pressure hose looped around the locking bar or bars of a container or trailer. This gas pressure hose holds the two way valve in the activated position so that gas is supplied to the pressure hose. If the pressure hose is broken or disconnected, pressure means move the two way valve to the security breached position allowing gas to go into an ink reservoir which releases the ink onto the container leaving a permanent identified mark. The two position valve can be deactivated by means to move the valve. This valve can be moved into the deactivated position by a magnet. This security seal can also be deactivated by supplying gas under pressure from an external source to hold the two way valve in the activated position which will allow the pressure hose to be disconnected.

33 Claims, 5 Drawing Sheets

SECURITY SEAL FOR CARGO CONTAINERS

CROSS-REFERENCE TO RELATED APPLICATION

This application is related to copending U.S. provisional patent application entitled "SECURITY SEAL FOR CARGO CONTAINERS" filed on Sep. 25, 2003 and accorded Ser. No. 60/506,106, which is entirely incorporated herein by reference.

FIELD OF THE INVENTION

This invention relates to a security seal which make a highly visible color marking on the doors of a cargo container if the container is unlawfully opened without deactivation of the security seal by authorized personnel with the proper deactivation equipment.

BACKGROUND OF THE INVENTION

Much cargo is shipped in large containers that are 20 to 40 feet long on ocean going vessels from one country to another. These containers have two doors on one end that are locked by locking bars that are secured into female locking receptacles in the frame of the container above and below the doors. A container door cannot be opened without unlocking the bar on that door and sometimes the bar on the other door as well. One door frequently overlaps the other door, in which case, only a bar is needed on the overlapping door. These containers are subject to pilferage, smuggling and acts of terrorism by unauthorized people opening the container after it has been locked at the point of origination of the shipment. When these containers are moving from one country to another, they frequently are inspected by custom officials before leaving the country of origin. They may also need to be inspected by customs officials upon entry into the country of final destination of the cargo. Because of the vast quantity of goods that are being shipped in these containers, these inspections by customs authorities and other government officials are expensive and time consuming and, consequently sometimes lack in thoroughness. It would be highly desirable to have a security system that could be activated by a customs official in the country of origin that would clearly identify whether the container had been opened or not to a custom official in a country through which the container is passing, or to a custom official in the country of final destination. These containers frequently pass from one shipper to another until they reach their final destination. Regardless of any inspections by customs officials, these shippers and the ultimate customer would like to have a security system that would tell them whether the container has been opened or tampered with. This is important not only for containers that go from one country to another, but also for containers that are shipped entirely within a single country. While the containers carrying cargo may not be very expensive, the cargo being carried may be extremely valuable or may be of extreme importance to national security if it contains military goods and the like.

The trailers that are pulled by tractors on the highways have similar doors to those on ocean going containers and are also locked by locking bars. It would be desirable to have a security system for these trailers as well. Even when the goods are not being carried from one country to another, a security system would be very valuable to detect pilferage or the adding of smuggled goods or contraband to the trailer in the unauthorized opening of the trailer.

The locking bars on these containers and trailers frequently have handles that can be locked together by a padlock or by a chain and padlock. In some cases these bars are locked only by a chain and padlock. These padlocks are relatively easy to "pick" and open allowing unauthorized personnel access to the cargo. These padlocks can then be relocked without leaving a trace of the unauthorized entry.

SUMMARY OF THE INVENTION

It is an object of this invention to develop a security system to clearly detect and indelibly mark the unauthorized opening of the doors of cargo containers, or other types of containers, and the trailers of tractor trailer rigs. It is a further object of this invention to develop a security system that will permit a custom official of one government to seal the shipping container and enable the customs officials of another government where the container is transported to quickly determine whether the container has been opened or tampered with in transit. It is a further object of this invention to develop a security system that will allow a container to be sealed by a customs official in one country and pass through another country without the necessity of the container being opened by customs officials and on to its final destination without the necessity of opening the container by customs officials in the country of destination. It is still another object of this invention to develop a security system that can be activated to seal a shipping container at its point of origin and be deactivated by authorized personnel at the point of destination so that the system can be reused on the same container or can be easily installed on another container. It is a further object of this invention to develop a security system that cannot easily be subverted by unauthorized persons and meets the security criteria of governmental customs officials of various countries.

The objects of this invention have been achieved by the development of a security seal which consists essentially of placing a pressure hose around the closing mechanism, such as one or both locking bars, of the container or a trailer with both ends of the pressure hose being secured and activated and deactivated within the security seal. The seal is preferably mechanically attached to one of the locking bars of the container door or to a container door itself by bolts or other types of mechanical attachment. The security seal has a internal gas cartridge which supplies pressurized air or another gas to the system when the security seal is activated. Because these containers, or trailers of a tractor trailer rig, may be subjected to very high temperatures or low atmospheric pressure, a security valve may be is attached to the cylinder or gas line or hose from the gas cartridge to prevent excess pressure build up in the pressure hose. This security valve can be set to prevent the build up of pressure above a preset pounds per square inch of pressure in the pressure hose. This will prevent excessive pressure build up in the pressure hose which could result in rupture of the hose which would result in a false marking by the security device.

The gas line from the gas cartridge connects to a 2/2 way valve which basically turns on the flow of gas from the gas cartridge when the valve is opened. The first step in activating this system is switching the 2/2 way valve to the flow position. This 2/2 way valve can be provided with a push button for activating the valve. Once the 2/2 way valve is switched to the flow position, gas flows through a gas line under pressure to the 4/2 way valve. The final activation of this system occurs with the spring activation of a spring on the 4/2 way valve which may be controlled by a switch or a remotely controlled solenoid. The gas pressure exerted on the 4/2 way valve holds this valve in the position which delivers pressurized gas to the pressure hose. Once the 4/2 way valve has been activated, the gas pressure from the gas cartridge moves through the valve into the position of communication with the pressure hose. The spring for 4/2 way valve is designed so that it does not overcome the pressure in the valve exerted by the gas cartridge when the system is active and secure. If someone cuts or disconnects the pressure hose after the system has been activated, the pressure on the 4/2 way valve provided by the system is greatly reduced and the spring pushes the 4/2 way valve into a position so that the pressurized gas moves through a line to an ink reservoir. This ink reservoir is put under high pressure, causing a membrane to burst, releasing ink to be splashed on the door of the container. A cone can be utilized so that a ring-shaped color marking, or other pattern, is sprayed on the container doors. This will alert customs officials or other authorized personnel that the container has been opened or tampered with.

This security seal can easily be deactivated by customs officials or authorized personnel by connecting a deactivating hose under pressure to a special coupling on the seal which is connected to the pressure hose. When pressure is applied by the external hose, the 4/2 way valve is held in the position so that it does not allow gas to flow into the ink reservoir. This external pressure from the deactivating hose overcomes the pressure imposed by the spring on the 4/2 way valve. It keeps the valve in the same position it was in when the system was activated. The pressure provided through coupling keeps the 4/2 way valve in the activated position allowing the pressure hose to be removed from the container bar or bars. While under this pressure through the coupling, the security seal can be detached from the container and attached to another container and reactivated. The 4/2 way valve can also be deactivated by a remotely controlled solenoid or other closing mechanism.

It should be realized that this security seal can be constructed by having a pressure hose extend around both bars on the container or trailer or only around one bar. The seal can be installed on one of the container doors and looped around the locking bar of the other container door. Thus, any opening of the doors without deactivating the system would break the pressure hose.

A special type of ink may be used for this system that is fast drying and clearly visible. The ink may contain isotopes or other indicators that will indicate the approximate time and date of the rupture of the pressure hose. This ink needs to be formulated so that it cannot be easily removed from the container without clearly leaving a visual image or other indicator of its removal. Under certain circumstances an ink that is only detectable under special light conditions, e.g. ultraviolet light, may be used.

DETAILED DESCRIPTION OF THE PREFERRED EMBODIMENT

Figure 1:
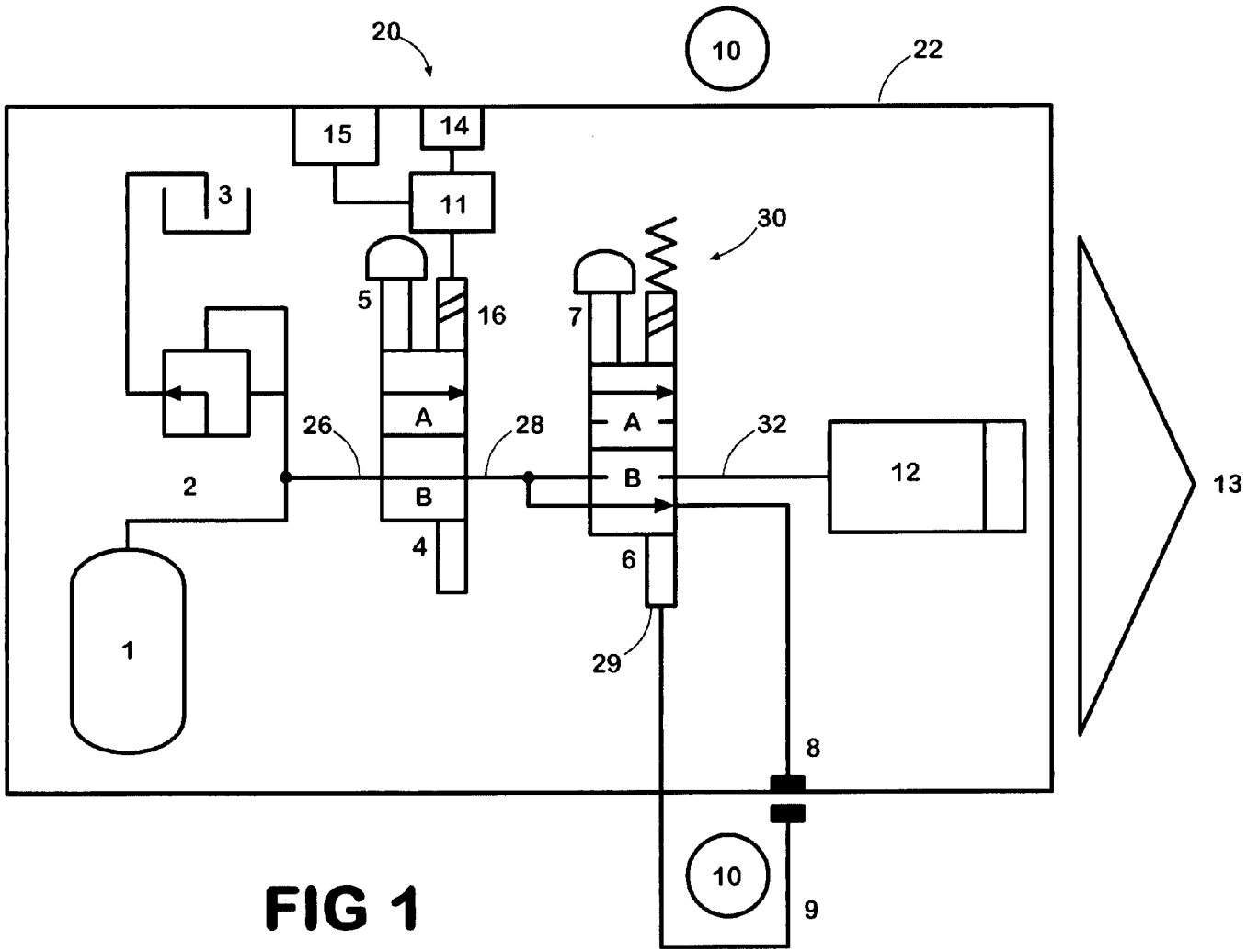
FIG. 1 is a block diagram of the security seal of this invention.
Figure 4:
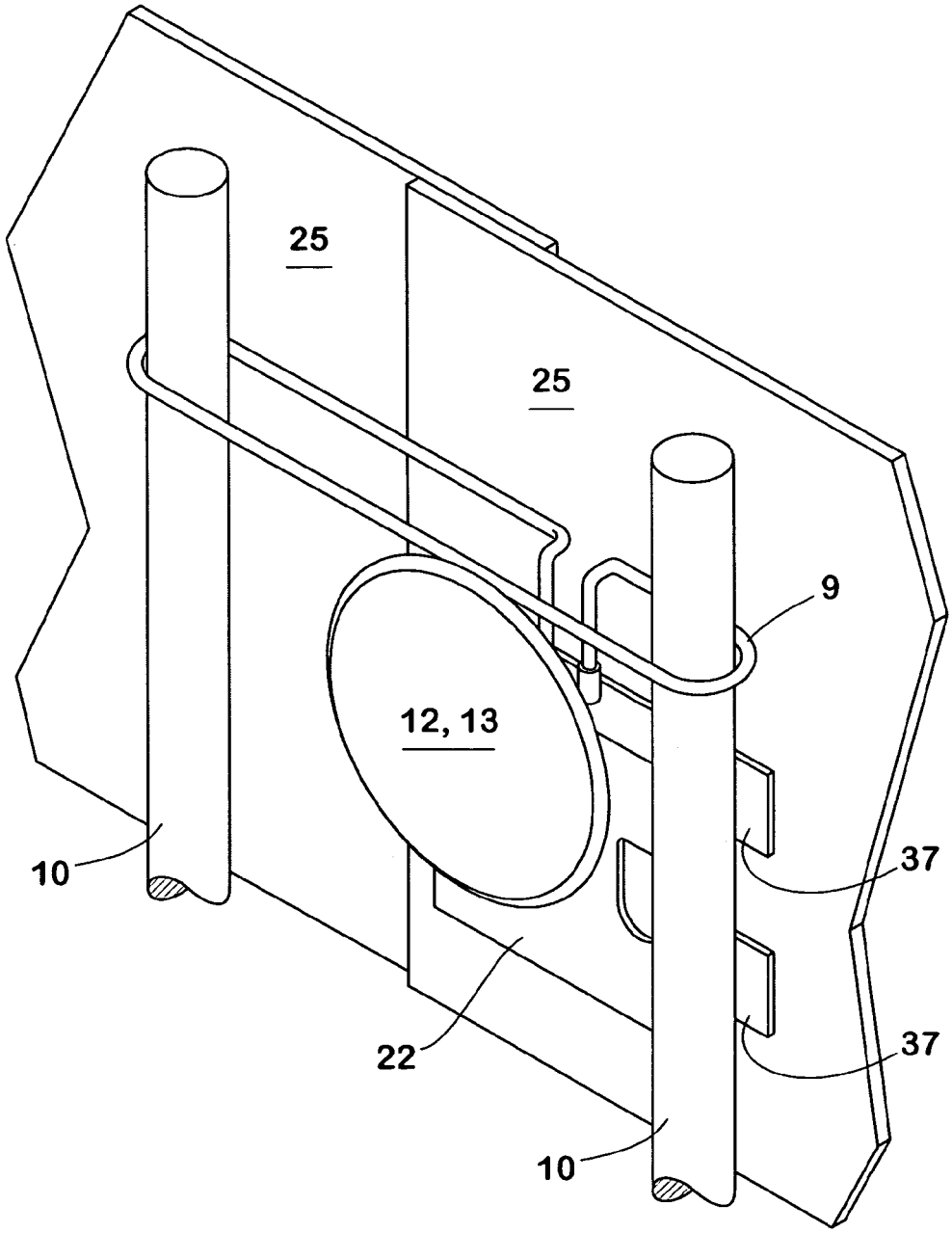
FIG. 4 is a perspective view of the security seal attached to the locking bars of a container.
Figure 5:
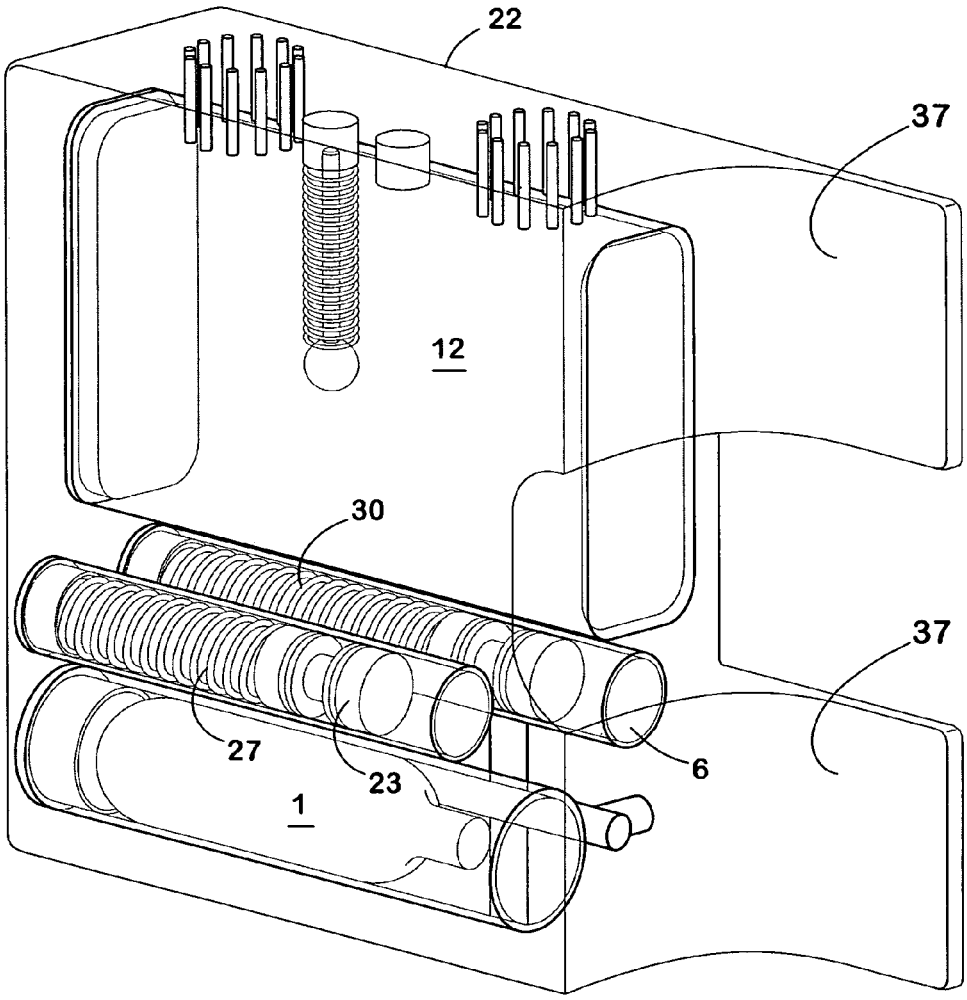
FIG. 5 is a schematic view of the of the security seal showing the main components.

A block diagram of the security seal of this invention is illustrated in FIG. 1. This security seal is designed to be attached to a container or the trailer of a tractors trailer rig for carrying cargo. The security seal is represented by the numeral 20 in FIG. 1. The main components of the security seal are housed in a case 22 which may be mechanically attached to container doors 25 as illustrated in FIG. 4. The case 22 can be attached to a container door 25 by bolts extending from the case and through the container door 25 with nuts holding them in place on the inside of the container door (not shown), which insures that the case 22 cannot be removed from the container door 25 except by removing the nuts on the inside of the container door. The case 22 may have flanges 37 which extend behind a bar 10 to hold the security seal 20 in place. Alternatively, the case 22 can be mechanically attached to one of the locking bars 10 of the container doors 25 by clamps or bolts or other mechanical attachment. Clamps can be secured by the clamps having threads that extend into the case by nuts on the inside of the case 22 (not shown). The clamps extend around the bar.

Figure 2:
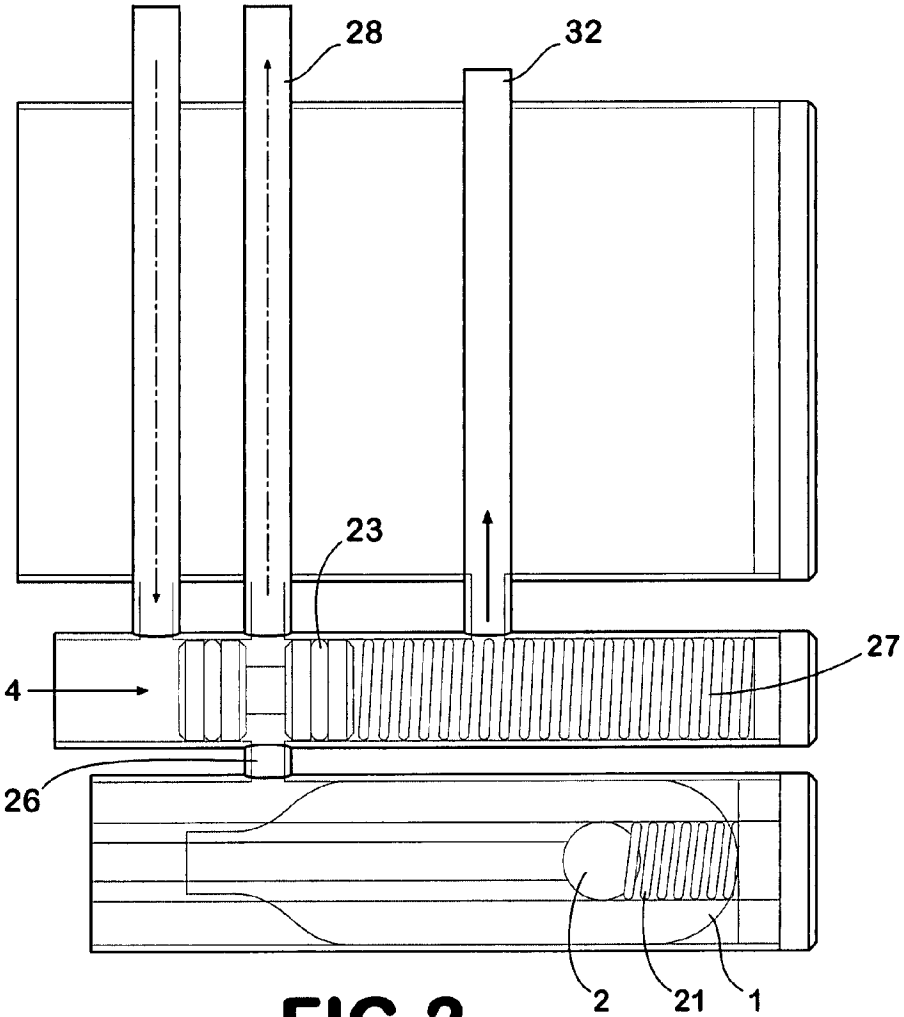
FIG. 2 is a schematic view showing the gas cartridge and the 2/2 way valve.
Figure 3:
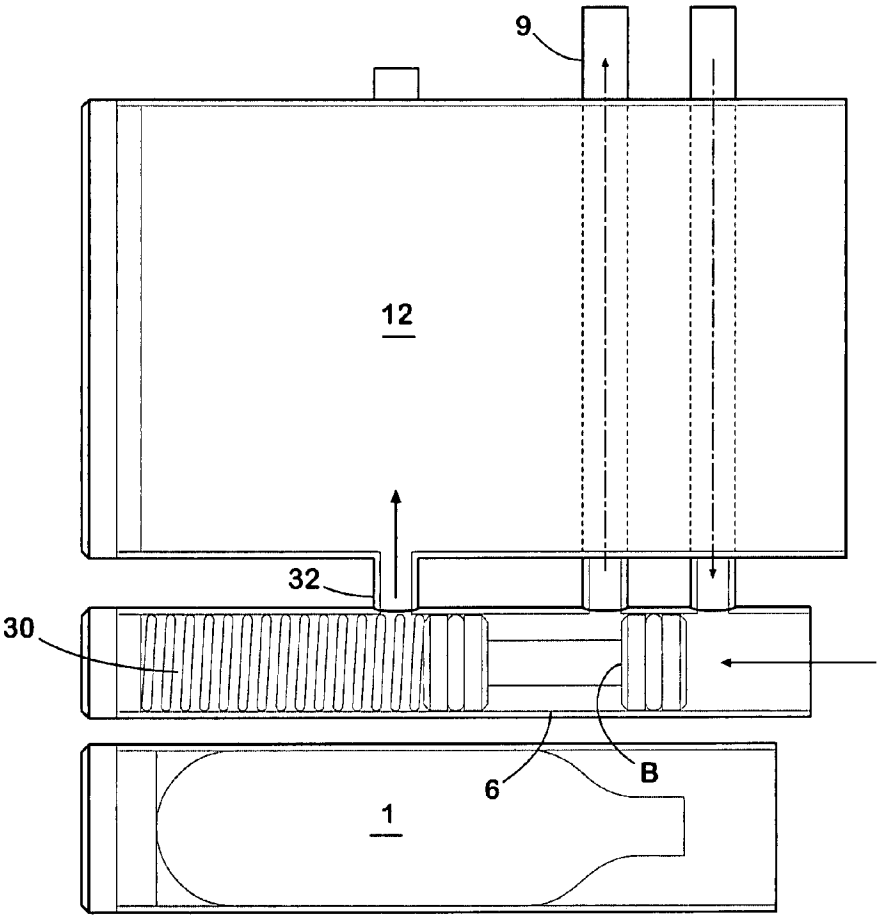
FIG. 3 is a schematic view showing a part of the container seal containing the gas cartridge, the 4/2 way valve and the ink container.

This security seal 20 is activated by a gas cartridge 1 which delivers gas at a controlled pressure to activate the system. This gas cartridge has a conventional security valve 2 and spring 21 as shown in FIGS. 1 and 2 that releases excessive gas pressure that may be built up, due to a temperature increase or a reduction in atmospheric pressure. In the case of a pressure build up, the security valve 2 releases gas through outlet 3 to stabilize the system. Gas flows through line 26 to 2/2 way valve 4 which can be switched to the flow position A from B by activating push button 5, which can be placed outside of the case 22. As a security feature, button 5 will not deactivate the seal. Pushing button 5 releases piston 23 which is pushed into the open position A by spring 27. The 2/2 way valve is held in the flow position A by a spring 27 as shown in FIG. 2. Once the 2/2 way valve has been activated, the spring 27 prevents the valve from being turned off.

The 2/2 way valve 4 is connected by gas line 28 to the 4/2 way valve 6. The 4/2 way valve 6 is activated by switch 7 which allows pressurized gas to flow through line 28 which holds valve 6 in position B which delivers gas to the pressure hose 9. Pushing the switch 7 activates the 4/2 way valve spring 30. Switch 7 can be designed so the system cannot be deactivated by the switch. The pressure of the gas through the 4/2 way valve 6 holds it in position B allowing the gas to flow through the pressure hose 9 as the pressure exerted by the spring 30 is balanced with the pressure of the gas. The gas returns to valve 6 at inlet 29. Valve 6 could be activated and deactivated by a battery powered solenoid which could only be activated by a coded radio frequency signal.

A battery powered clock indicating both date and time could be included in the security seal 20 to indicate the date and time the pressure hose 9 was broken. The redirection of pressure to the pressure hose 9 could stop the clock at the date and time of the drop in pressure.

It is also possible to add an anti-drying compound to the ink which allows the slow drying of the ink on exposure to air in a manner that can determine the approximate time when the pressure hose was ruptured. The term "ink" refers to any type of marker or dye that can be forced onto the container doors 25 under pressure which indicates that the security of the container has been breached.

The pressure hose 9 may be looped around a locking bar 10 or bars as illustrated in FIGS. 1 and 4. It is possible for the pressure hose 9 to be locked around a single bar 10 as shown in FIG. 1 with the case 22 installed on the adjoining door 25 of the container, so that if the container door 25 is opened the pressure hose 9 is broken.

Cutting or breaking the pressure hose 9 allows the 4/2 way valve spring 30 to push the 4/2 way valve 6 into position A which allows the gas to flow through gas line 32 to the ink reservoir 12 causing a membrane in the ink container 12 to burst which can spray ink onto the container door 25. This ink can be sprayed onto a container door 25 by using a cone 13 to produce a ring shaped color marking or other pattern. The pressure hose 9 can be wrapped around any closing mechanism for the doors 25 in a manner so the hose is severed if the closing mechanism is opened.

The ink used needs to be rapidly drying to prevent it being removed before it dries. This ink can contain indicators or isotopes to help pin point the date and time that the container was opened. The ink can contain reflective particles so the marks become very visible in daylight. The ink can also contain fluorescent material to enhance the visibility of the marking.

This system can be deactivated by connecting it to an external power source through interface 14 as illustrated in FIG. 1. When the security seal 20 is initially activated a code may be programmed into the code reader 15 with a memory. That same code must be entered into the code reader 15 either by a key pad or data card to deactivate the security seal 20. Once that code has been entered into the code reader 15, the relay 11 will deliver power to a motor, magnet or solenoid 16 which will move piston 23 into position B. The code for deactivating the unit can be posted on the bill of lading or other transport document that is forwarded to the recipient of the container for deactivating the security seal. Another way of deactivating the seal is by using remote control to control valve 4 by a solenoid or other moving means. Only a small battery would be needed to deactivate valve 4.

The security seal 20 can be reactivated by programming a new code into the code reader 15 while the security seal 20 is connected to an external power source through interface 14. This code will disconnect the external electrical supply which will result in deactivating the magnet 16 so that piston 23 is pushed by spring 27 into the flow position A.

The security seal 20 can also be deactivated by disconnecting hose 9 from connector 8 and attaching an outside pressure hose to connector 8 which will need a device, such as a one way valve to prevent the drop of pressure in the hose. The security seal can then be reconnected to another container and reactivated by disconnecting the outside hose and reconnecting hose 9. Special fittings can be used to provide security against unauthorized people connecting an outside hose without the secure fittings to connector 8.

The security seal 20 can be attached to another container either by clamping on a locking bar 10 or by using bolts to attach to the container door. Holes can be predrilled in container doors to allow the security seal to be quickly reattached.

While the security seal 20 is in the deactivated stage pressure hose 9 can be disconnected from connector 8 and removed from one container and reconnected to another container and reactivated by following the steps described above for reactivation.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. A security seal for containers which has at least one door that can be closed and unclosed by a closing mechanism, said security seal when activated being designed to place ink on the container when a door has been opened without proper deactivation of the security seal, comprising a gas cartridge in communication with a two position valve that can be opened and c1osed and having means to open said valve, whereby when said valve is open it allows gas to flow from said gas cartridge through said two position valve to a two way valve and having means to activate said two way valve, which in the activated position is in communication with a pressure hose which is looped around the closing mechanism of the container in a manner so that the closing mechanism can not be opened without removing or severing the pressure hose, said two way valve held in the activated position by pressure exerted on the two way valve from gas flowing from the gas cartridge, said two way valve having a security breached position, said two way valve having moving means to automatically move the two way valve to the security breached position if pressure in the pressure hose is reduced due to the hose being removed from the closing mechanism or being severed, said pressure means moving said two way valve to the security breached position where the two way valve is in communication with an ink reservoir which has the capability of releasing its contents onto the container when under pressure from said gas cartridge leaving a marker indicating that security has been breached.

2. The security seal of claim 1, in which the moving means to move the two way valve to the security breached position is a spring positioned to exert pressure on said two way valve to balance the pressure exerted by the gas flowing from the gas cartridge when the pressure hose has not been breached or removed, but with the spring pressure being sufficient to move the two way valve to the security breached position when the pressure hose has been breached or removed.

3. The security seal of claim 2, in which the container has two doors with the closing mechanism being a locking bar for each door and the pressure hose is looped around both locking bars for two doors so neither door can be opened without removing or severing the pressure hose.

4. The security seal of claim 2, in which the container has two doors with at least one locking bar holding one door in the closed position and the pressure hose is looped around said locking bar with the remaining parts of the security seal being attached to the other door.

5. The security seal of claim 2, in which all parts of the security seal except for the pressure hose are contained in a case that is attached to the container.

6. The security seal of claim 2, which has secured means to move the two position valve from the activated to the deactivated position.

7. The security seal of claim 6, in which the secured means includes an interface for connecting an external power supply to a relay, programmable code reader connected to the relay which is connected to a magnet which is capable of being activated to deactivate the two position valve.

8. The security seal of claim 7, in which said ink reservoir has a membrane that breaks under pressure releasing its contents onto the container.

9. The security seal of claim 8, which has a cone interposed between said membrane and the container so that when said membrane is broken the ink is released onto said cone which produces the pattern on the container or trailer.

10. The security seal of claim 7, which has a security valve to prevent excessive pressure building in the pressure hose due to temperature increases or decreases in atmospheric pressure surround the pressure hose.

11. The security seal of claim 6, which is capable of being detached from the container to which it is attached while the security seal is deactivated with means to reactivate the security seal when reattached to a container.

12. The security seal of claim 11, in which said ink reservoir has a membrane that breaks under pressure of gas releasing the ink onto the container.

13. The security seal of claim 6, in which the secured means to move the two position valve between the activated and deactivated position is a remote control and receiver in the case for commanding a moving means in the case for moving the two way valve.

14. The security seal of claim 2, in which said ink reservoir has a membrane that breaks under pressure of gas releasing the ink onto the container.

15. The security seal of claim 14, which has a pattern making cone interposed between said membrane and the container so that when said membrane is broken the ink is released onto said cone which produces a pattern on the container.

16. The security seal of claim 2, which has a security valve to prevent excessive pressure building in the pressure hose due to temperature increases or decreases in the atmospheric pressure surrounding the pressure hose.

17. The security seal of claim 1, in which the container has two doors with the closing mechanism being a locking bar for each door and the pressure hose is looped around both locking bars for two doors so neither door can be opened without removing or severing the pressure hose.

18. The security seal of claim 1, in which the container has two doors with at least one locking bar holding one door in the closed position and the pressure hose is looped around said locking bar with the remaining parts of the security seal being attached to the other door.

19. The security seal of claim 1, in which all parts of the security seal except for the pressure hose are contained in a case that is attached to the container.

20. The security seal of claim 1, which has secured means to move the two position valve from the activated to the deactivated position.

21. The security seal of claim 20, in which the secured means includes an interface for connecting an external power supply to a relay, programmable code reader connected to the relay which is connected to a magnet which is capable of being activated to deactivate the two position valve.

22. The security seal of claim 1, in which the container has a least one door which is held in position by a locking bar and the security seal has means for attaching to the locking bar.

23. The security seal of claim 1, in which said ink reservoir has means to release the ink onto the container under the pressure of gas.

24. The security seal of claim 1, which has a security valve to prevent excessive pressure building in the pressure hose due to temperature increases or decreases in the atmospheric pressure surrounding the pressure hose.

25. A security seal for containers which has at least one door that is locked and unlocked by a locking bar, said security seal when activated being designed to place ink on the container when the doors have been opened without proper deactivation of the security seal, comprising:

(a) a gas cartridge in communication with a two position valve that can be opened and closed and having means to open said valve, whereby when said valve is open it allows gas to flow from said gas cartridge through said two position valve to a two way valve having means to activate said two way valve, which in the activated position is in communication with a pressure hose which is looped around at least one locking bar of the container, said two way valve held in the activated position by pressure exerted on the two way valve from gas flowing from the gas cartridge, said two way valve having a security breached position, said two way valve having moving means to automatically move the two way valve to the security breached position if pressure in the pressure hose is reduced due to the hose being removed from the locking bar or being severed, said pressure means moving said two way valve to the security breached position where the two way valve is in communication with an ink reservoir which will release its contents onto the container when under pressure from said gas cartridge;

(b) means to deactivate the security seal by supplying gas under pressure from an external source to said two way valve to hold it in the activated position, said pressure hose having coupling means so the hose can be removed from its position looped around at least one locking bar, while said two way valve is held in the activated position by the pressurized gas supplied from an external source; and (c) with said security seal being capable of being reactivated on the same container by closing all the doors and looping the pressure hose around at least one locking bar and recoupling the pressure hose and disconnecting the external source of gas which reactivates the security seal.

26. The security seal of claim 25, in which the moving means to automatically move the two way valve to the security breached positioned is a spring positioned to exert pressure on said two way valve balanced to counteract the pressure exerted by the gas flowing from the gas cartridge when the pressure hose has not been breached or removed, but with the spring pressure being sufficient to move the two way valve to the security breached position when the pressure hose has been breached or removed.

27. The security seal of claim 25, in which said ink reservoir has a membrane that breaks under pressure releasing its contents onto the container.

28. The security seal of claim 27, which has a cone interposed between said membrane and the container so that when said membrane is broken the ink is released onto said cone which produces the pattern on the container.

29. The security seal of claim 25, which has a security valve to prevent excessive pressure building in the pressure hose due to temperature increases or decreases in atmospheric pressure surround the pressure hose.

30. A security seal for containers which has at least one door that is locked and unlocked by a locking bar, said security seal when activated being designed to place ink on the container when the doors have been opened without proper deactivation of the security seal, comprising:

(a) a gas cartridge in communication with a two position valve that can be opened and closed and having means to open said valve, whereby when said valve is open it allows gas to flow from said gas cartridge through said two position valve to a two way valve and having means to activate said two way valve, which in the activated position is in communication with a pressure hose which is looped around at least one locking bar of the container, said two way valve held in the activated position by pressure exerted on the two way valve from gas flowing from the gas cartridge, said two way valve having a security breached position, said two way valve having moving means to automatically move the two way valve to the security breached position if pressure in the pressure hose is reduced due to the hose being removed from the locking bar or being severed, said pressure means moving said two way valve to the security breached position where the two way valve is in communication with an ink reservoir which will release its contents onto the container when under pressure from said gas cartridge; and (b) said security seal having secured means to move the two position valve from the activated to the deactivated position so the hose can be removed from its position looped around at least one locking bar without discharging any ink from the ink reservoir.

31. The security seal of claim 30, in which the moving means to move the two way valve to the security breached position is a spring positioned to exert pressure on said two way valve to balance the pressure exerted by the gas flowing from the gas cartridge when the pressure hose has not been breached or removed, but with the spring pressure being sufficient to move the two way valve to the security breached position when the pressure hose has been breached or removed.

32. The security seal of claim 31, which is capable of being reactivated on the same container by closing all the doors and looping the pressure hose around at least one locking bar and recoupling the pressure hose.

33. The security seal of claim 30, in which the secured means to move the two position valve between the activated and deactivated position is a remote control and receiver in the case for commanding a moving means in the case for moving the two way valve.

* * * * *